US009373891B2

(12) United States Patent
Bennett et al.

(10) Patent No.: US 9,373,891 B2
(45) Date of Patent: Jun. 21, 2016

(54) SMOOTH-WALLED FEEDHORN

(71) Applicants: The Johns Hopkins University, Baltimore, MD (US); The United States of America, As Represented by the Administrator of the National Aeronautics and Space Administration, Washington, DC (US)

(72) Inventors: Charles L. Bennett, Baltimore, MD (US); Lingzhen Zeng, Baltimore, MD (US); Edward J. Wollack, Clarksville, MD (US); David T. Chuss, Greenbelt, MD (US)

(73) Assignees: The Johns Hopkins University, Baltimore, MD (US); The United States of America, As Represented by the Administration of the National Aeronautics and Space Administration, Greenbelt, MD (US)

( * ) Notice: Subject to any disclaimer, the term of this patent is extended or adjusted under 35 U.S.C. 154(b) by 0 days.

(21) Appl. No.: 14/820,514

(22) Filed: Aug. 6, 2015

(65) Prior Publication Data

US 2015/0349426 A1 Dec. 3, 2015

Related U.S. Application Data

(62) Division of application No. 13/393,098, filed as application No. PCT/US2010/052068 on Oct. 8, 2010, now Pat. No. 9,166,297.

(60) Provisional application No. 61/250,032, filed on Oct. 9, 2009.

(51) Int. Cl.
*H01Q 13/00* (2006.01)
*H01Q 13/02* (2006.01)

(52) U.S. Cl.
CPC ..... *H01Q 13/0283* (2013.01); *H01Q 13/02* (2013.01); *Y10T 29/49016* (2015.01); *Y10T 29/49018* (2015.01)

(58) Field of Classification Search
USPC ..... 343/772, 786
See application file for complete search history.

(56) References Cited

U.S. PATENT DOCUMENTS 6,411,263 B1 6/2002 Neilson
2002/0000945 A1 1/2002 Amyotte et al.

(Continued)

FOREIGN PATENT DOCUMENTS

JP 2005-531947 A 10/2005

OTHER PUBLICATIONS

Christophe Granet, Graeme L. James and Graham Moorey; "A Smooth-Walled Spline-Profile Horn as an Alternative to the Corrugated Horn for Wide Band Milimeter-Wave Applications"; Mar. 2004; IEEE Transactions on Antennas and Propagation, vol. 52.*

(Continued)

*Primary Examiner* — Hoang V Nguyen
*Assistant Examiner* — Hai Tran
(74) *Attorney, Agent, or Firm* — Venable LLP; Henry J. Daley; Laura G. Remus

(57) ABSTRACT

A device for at least one of receiving and transmitting electromagnetic radiation includes a feedhorn having a substantially smooth, electrically conducting inner surface extending from an open end to a feed end, the inner surface being substantially rotationally symmetrical about a longitudinal axis, wherein an orthogonal distance from a point on the longitudinal axis to the substantially smooth, electrically conducting inner surface increases monotonically as the point on the longitudinal axis is selected at successively greater distances from the feed end of the feedhorn towards the open end of the feedhorn such that a profile of the substantially smooth, electrically conducting inner surface of the feedhorn is monotonically increasing. The feedhorn has an operating bandwidth and the feedhorn provides a maximum of −30 dB cross polarization response over at least 15% of the operating bandwidth. A method of producing a feedhorn for receiving or transmitting electromagnetic radiation includes determining a profile of an inner surface of the feedhorn based on constraints required to achieve a plurality of operating parameters, providing a pre-machined feedhorn having an initial inner surface, and machining the initial inner surface of the pre-machined feedhorn to substantially match the profile determined to achieve the plurality of operating parameters for the feedhorn. The determining the profile includes a constraint for the profile to be a monotonically increasing profile relative to a rotational symmetry axis of the inner surface of the feedhorn going from a narrow end to a wide end of the feedhorn.

11 Claims, 7 Drawing Sheets

(56) References Cited

U.S. PATENT DOCUMENTS

2005/0237239 A1 10/2005 Kuo et al.
2006/0125706 A1 6/2006 Amyotte et al.

OTHER PUBLICATIONS

International Search Report and Written Opinion of PCT/US2010/052068.
Bird, "A multibeam feed for the parker radio-telescope," IEEE Antennas & Propagation Symposium, pp. 966-969, 1994.
Deguchi et al., "Compact low-cross-polarization horn antennas with serpentine-shaped taper," IEEE Transactions on Antennas and Propagation, vol. 52, No. 10, pp. 2510-2516, 2004.
Ediss, "Technical memorandum. dual-mode horns at millimetre and submillimetre wavelengths," IEE Proceedings H Microwaves Antennas and Propagation, vol. 132, No. 3, pp. 215-218, 1985.
Fixsen, "Multimode antenna optimization," R. Winston, Ed., vol. 4446, No. 1, SPIE, 2001, pp. 161-170.
Fixsen et al., "Lightweight long-hold-time dewar," Review of Scientific Instruments, vol. 72, No. 7, pp. 3112-3120, 2001.
Granet et al., "A smooth-walled spline-profile horn as an alternative to the corrugated horn for wide band millimeter-wave applications," IEEE Transactions on Antennas and Propagation, vol. 52, No. 3, pp. 848-854, 2004.
Hesler et al., "Recommendations for waveguide interfaces and frequency bands to 1 THz," 18th International Symposium on Space Terahertz Technology, pp. 100-103, 2007.
James, "Analysis and design of TE II to HE11 corrugated cylindrical waveguide mode converters," IEEE Transactions on Microwave Theory and Techniques, vol. MTT-29, No. 10, pp. 1059-1066, 1981.
Kittara et al., "The design of potter horns for THz applications using a genetic algorithm," International Journal of Infrared and Millimeter Waves, vol. 28, pp. 1103-1114, 2007.
Lier, "Cross polarization from dual mode horn antennas," IEEE Transactions on Antennas and Propagation, vol. 34, No. 1, pp. 106-110, 1986.
Ludwig, "The definition of cross polarization," IEEE Transactions on Antennas and Propagation, vol. 21, No. 1, pp. 116-119, 1973.
Neilson, "An improved multimode horn for Gaussian mode generation at millimeter and submillimeter wavelengths," IEEE Transactions on Antennas and Propagation, vol. 50, No. 8, pp. 1077-1081, 2002.
Pickett et al., "Characterization of a dual-mode horn for submillimeter wavelengths (short papers)," IEEE Transactions on Microwave Theory and Techniques, vol. 32, No. 8, pp. 936-937, 1984.
Potter, "A new horn antenna with suppressed sidelobes and equal beamwidths," Microwave Journal, pp. 71-78, Jun. 19, 1963.
Pyle et al., "Cutoff wavelengths of waveguides with unusual cross sections (correspondence)," IEEE Transactions on Microwave Theory and Techniques, vol. 12, No. 5, pp. 556-557, 1964.
Skobelev et al., "Optimum geometry and performance of a dual-mode horn modification," IEEE Antennas and Propagation Magazine, vol. 43, No. 1, pp. 90-93, 2001.
Tun et al., "Computer optimised wideband dual-mode horn," Electronics Letters, vol. 38, No. 15, pp. 768-769, 2001.
Turrin, "Dual mode small-aperture antennas," IEEE Transactions on Antennas and Propagation, vol. 15, No. 2, pp. 307-308, 1967.
Wollack, "TCHEB_x: Homogeneous stepped waveguide transformers," NRAO, EDTN Memo Series # 176, 1996.
Yassin et al., "A high performance horn for large format focal plane arrays," 18th International Symposium on Space Terahertz Technology, pp. 1-12, Apr. 2008.
C. Granet and G. L. James, "Spline-Profile Smooth-Walled C-Band Horn", 2007, IEEE Transactions on Antennas and Propagation Letters, vol. 6, pp. 415-418.

* cited by examiner

SMOOTH-WALLED FEEDHORN

CROSS-REFERENCE OF RELATED APPLICATION

This application is a Divisional of U.S. patent application Ser. No. 13/393,098 filed Feb. 28, 2012 the entire contents of which are hereby incorporated by reference. U.S. patent application Ser. No. 13/393,098 is a national stage application under 35 U.S.C. 371 of PCT/US2010/052068 filed Oct. 8, 2010, the entire contents of which are incorporated herein by reference. This application claims priority to U.S. Provisional Application No. 61/250,032 filed Oct. 9, 2009, the entire contents of which are hereby incorporated by reference.

BACKGROUND

1. Field of Invention

The current invention relates to feedhorns for receiving and/or transmitting electromagnetic radiation, and more particularly to smooth-walled feedhorns for receiving and/or transmitting electromagnetic radiation.

2. Discussion of Related Art

Many precision microwave applications, including those associated with radio astronomy, require feedhorns with symmetric E- and H-plane beam patterns that possess low sidelobes and cross-polarization control. A common approach to achieving these goals is a "scalar" feed, which has a beam response that is independent of azimuthal angle. Corrugated feeds (P. Clarricoats and A. Olver, *Corrugated Horns for Microwave Antennas*. London, U.K.: Peregrinus, 1984) approximate this idealization by providing the appropriate boundary conditions for the $HE_{11}$ hybrid mode at the feed aperture. Corrugated feedhorns require high-precision grooves in the walls of the feedhorns, often to a within a small fraction of a wavelength (e.g., ~$0.0022\lambda_c$ where $\lambda_c$ is the cutoff wavelength of the input guide section). In addition, the manufacturing by direct machining of each groove can leave small burrs in the grooves that can adversely affect the properties of the feedhorn, thus requiring further labor-intensive inspection and correction. Alternatively, chemically electroformed corrugated feed horns require the use of a precision mandrel for each assembly which is destroyed in the fabrication process. Consequently, feedhorns that have corrugated walls are expensive and labor-intensive to produce.

Alternatively, an approximation to a scalar feed can be obtained with a multimode feed design. One such "dual-mode" horn is the Potter horn (P. Potter, "A new horn antenna with suppressed sidelobes and equal beamwidths," *Microwave Journal*, pp. 71-78, June 1963). In this implementation, an appropriate admixture of $TM_{11}$ is generated from the initial $TE_{11}$ mode using a concentric step discontinuity in the waveguide. The two modes are then phased to achieve the proper field distribution at the feed aperture using a length of waveguide. The length of the phasing section limits the bandwidth due to the dispersion between the modes. Lier (E. Lier, "Cross polarization from dual mode horn antennas," *IEEE Transactions on Antennas and Propagation*, vol. 34, no. 1, pp. 106-110, 1986) has reviewed the cross-polarization properties of dual-mode horn antennas for selected geometries. Others have produced variations on this basic design concept (R. Turrin, "Dual mode small-aperture antennas," *IEEE Transactions on Antennas and Propagation*, vol. 15, no. 2, pp. 307-308, 1967; G. Ediss, "Technical memorandum. dual-mode horns at millimeter and submillimeter wavelengths," *IEE Proceedings H Microwaves Antennas and Propagation*, vol. 132, no. 3, pp. 215-218, 1985). Improvements in the bandwidth have been realized by decreasing the phase difference between the two modes by $2\pi$ (H. Pickett, J. Hardy, and J. Farhoomand, "Characterization of a dual-mode horn for submillimeter wavelengths (short papers)," *IEEE Transactions on Microwave Theory and Techniques*, vol. 32, no. 8, pp. 936-937, 1984; S. Skobelev, B.-J. Ku, A. Shishlov, and D.-S. Ahn, "Optimum geometry and performance of a dual-mode horn modification," *IEEE Antennas and Propagation Magazine*, vol. 43, no. 1, pp. 90-93, 2001).

To increase the bandwidth, it is possible to add multiple concentric step continuities with the appropriate modal phasing (T. S. Bird, "A multibeam feed for the parker radiotelescope," *IEEE Antennas & Propagation Symposium*, pp. 966-969, 1994; S. M. Tun and P. Foster, "Computer optimised wideband dual-mode horn," Electronics Letters, vol. 38, no. 15, pp. 768-769, 2001). A variation on this technique is to use several distinct linear tapers to generate the proper modal content and phasing (G. Yassin, P. Kittara, A. Jiralucksanawong, S. Wangsuya, J. Leech, and M. Jones, "A high performance horn for large format focal plane arrays," 18*th International Symposium on Space Terahertz Technology*, pp. 1-12, April 2008; P. Kittara, A. Jiralucksanawong, G. Yassin, S. Wangsuya, and J. Leech, "The design of potter horns for THz applications using a genetic algorithm," *International Journal of Infrared and Millimeter Waves*, vol. 28, pp. 1103-1114, 2007). Operational bandwidths of 15-20% have been reported using such techniques. A related class of devices is realized by allowing the feedhorn profile to vary smoothly rather than in discrete steps. Examples of such smooth-walled feedhorns with about 15% fractional bandwidths have been reported (G. Granet, G. L. James, R. Bolton, and G. Moorey, "A smooth-walled spline-profile horn as an alternative to the corrugated horn for wide band millimeter-wave applications," *IEEE Transactions on Antennas and Propagation*, vol. 52, no. 3, pp. 848-854, 2004; J. M. Neilson, "An improved multimode horn for Gaussian mode generation at millimeter and submillimeter wavelengths," *IEEE Transactions on Antennas and Propagation*, vol. 50, no. 8, pp. 1077-1081, 2002). However, there remains a need for improved smooth-walled feedhorns, for example, smooth-walled feedhorns that have greater than a 15% bandwidth with low cross-polarization response.

SUMMARY

A device for at least one of receiving and transmitting electromagnetic radiation according to an embodiment of the current invention includes a feedhorn having a substantially smooth, electrically conducting inner surface extending from an open end to a feed end, the inner surface being substantially rotationally symmetrical about a longitudinal axis, wherein an orthogonal distance from a point on the longitudinal axis to the substantially smooth, electrically conducting inner surface increases monotonically as the point on the longitudinal axis is selected at successively greater distances from the feed end of the feedhorn towards the open end of the feedhorn such that a profile of the substantially smooth, electrically conducting inner surface of the feedhorn is monotonically increasing. The feedhorn has an operating bandwidth and the feedhorn provides a maximum of −30 dB cross polarization response over at least 15% of the operating bandwidth.

A method of producing a feedhorn for receiving or transmitting electromagnetic radiation according to an embodiment of the current invention includes determining a profile of an inner surface of the feedhorn based on constraints required to achieve a plurality of operating parameters, providing a pre-machined feedhorn having an initial inner surface, and machining the initial inner surface of the pre-machined feedhorn to substantially match the profile determined to achieve the plurality of operating parameters for the feedhorn. The determining the profile includes a constraint for the profile to be a monotonically increasing profile relative to a rotational symmetry axis of the inner surface of the feedhorn going from a narrow end to a wide end of the feedhorn.

BRIEF DESCRIPTION OF THE DRAWINGS

Further objectives and advantages will become apparent from a consideration of the description, drawings, and examples.

In FIG. 2 (Top), the maximum cross-polar response across the band is shown for the three profiles corresponding to FIG. 1C. Measurements of the maximum cross-polarization are superposed. In FIG. 2 (Bottom), the reflected power measurements for the final feed horn are shown plotted over the predicted reflected power for the initial, intermediate, and final feedhorn profiles. Frequency is given in units of the cutoff frequency of the input circular waveguide.

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification are incorporated by reference as if each had been individually incorporated.

Some embodiments of the current invention are directed to smooth-walled feedhorns that have good operational bandwidths. An optimization technique according to an embodiment of the current invention is described, and the performance of an example of a feedhorn according to an embodiment of the current invention is compared with other published dual-mode feedhorns. A feedhorn according to some embodiments of the current invention has a monotonic profile that can allow it to be manufactured by progressively milling the profile using a set of custom tools. Due to its monotonic profile feedhorns according to some embodiments of the current invention could also be made by the approaches discussed in the above Background section, however, at significantly lower effort and cost since the entire structure can either be directly machined with a set of progressive tools (rather than a groove at a time) or electroformed from a reusable mandrel.

Figure 1A:
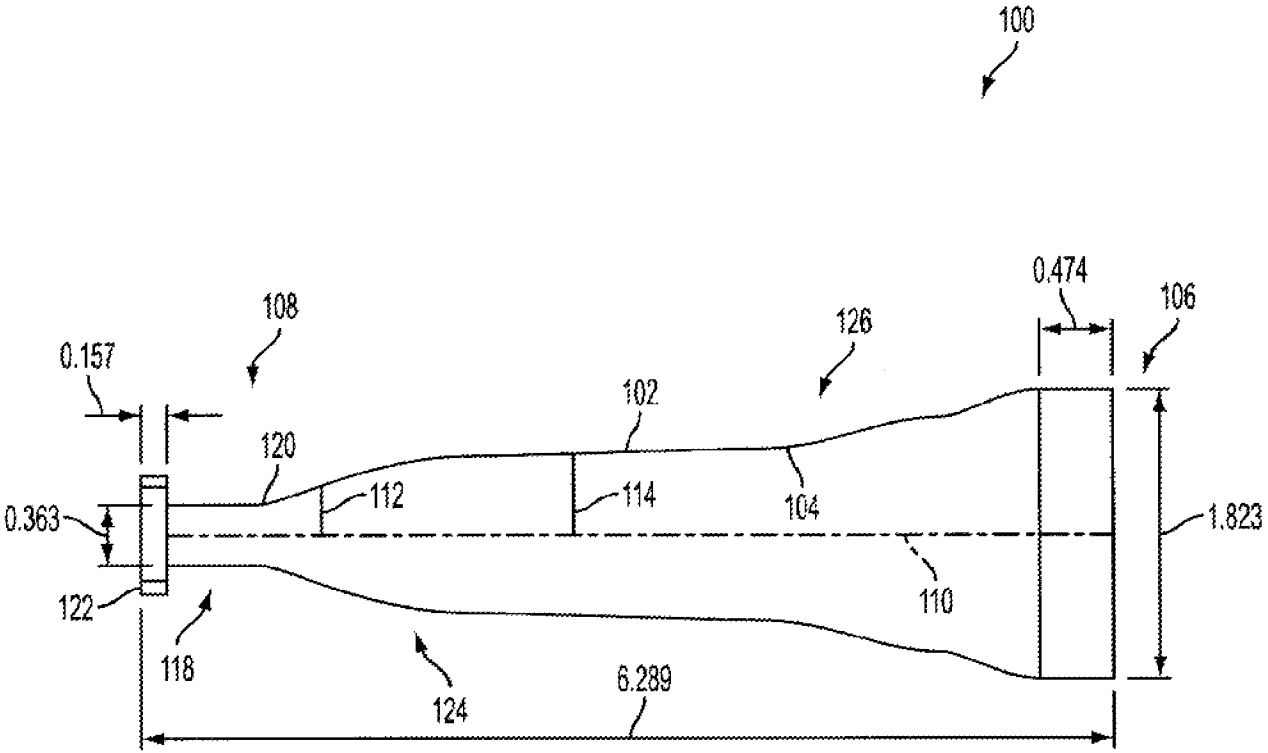
FIG. 1A is a cross-section view of a device for at least one of receiving and transmitting electromagnetic radiation according to an embodiment of the current invention.

FIG. 1A is a cross-sectional illustration of a device 100 for at least one of receiving and transmitting electromagnetic radiation according to an embodiment of the current invention. The device 100 comprises a feedhorn 102 having a substantially smooth, electrically conducting inner surface 104 extending from an open end 106 to a feed end 108 of the feedhorn 102. The outer surface of the device 100 is not critical to the operation of the device 100 and can be selected, as desired. The inner surface 104 of the feedhorn 102 is substantially rotationally symmetrical about a longitudinal axis 110 along the center of the feedhorn 102. An orthogonal distance 112 from a point on longitudinal axis 110 to inner surface 104 increases monotonically as the point on the longitudinal axis is selected at successively greater distances from the feed end 108 of the feedhorn 102 towards the open end 106 of the feedhorn 102 (e.g., orthogonal distance 114) such that a profile of the substantially smooth, electrically conducting inner surface 104 of the feedhorn 102 is monotonically increasing. According to an embodiment of the current invention, the shape of the inner surface 104 is also selected such that the feedhorn 102 has an operating bandwidth with a maximum of −30 dB cross polarization response over at least 15% of the operating bandwidth. According to an embodiment of the current invention, the shape of the inner surface 104 is also selected such that the feedhorn 102 has an operating bandwidth with a maximum of −30 dB cross polarization response over at least 20% of the operating bandwidth such that the feedhorn can be conveniently used with available microwave components. According to a further embodiment of the current invention, the shape of the inner surface 104 is also selected such that the feedhorn 102 has an operating bandwidth with a maximum of −30 dB cross polarization response over at least 30% of the operating bandwidth such that the feedhorn 102 can be useful in place of many currently available high-precision corrugated feedhorns. According to some embodiments of the current invention, the shape of the inner surface 104 is also selected such that the feedhorn 102 has a return loss of less than about −25 dB. According to some embodiments of the current invention, the shape of the inner surface 104 is also selected such that the feedhorn 102 has side lobes of response that are less than at least −20 dB below a peak response of the feedhorn.

Figure 1B:
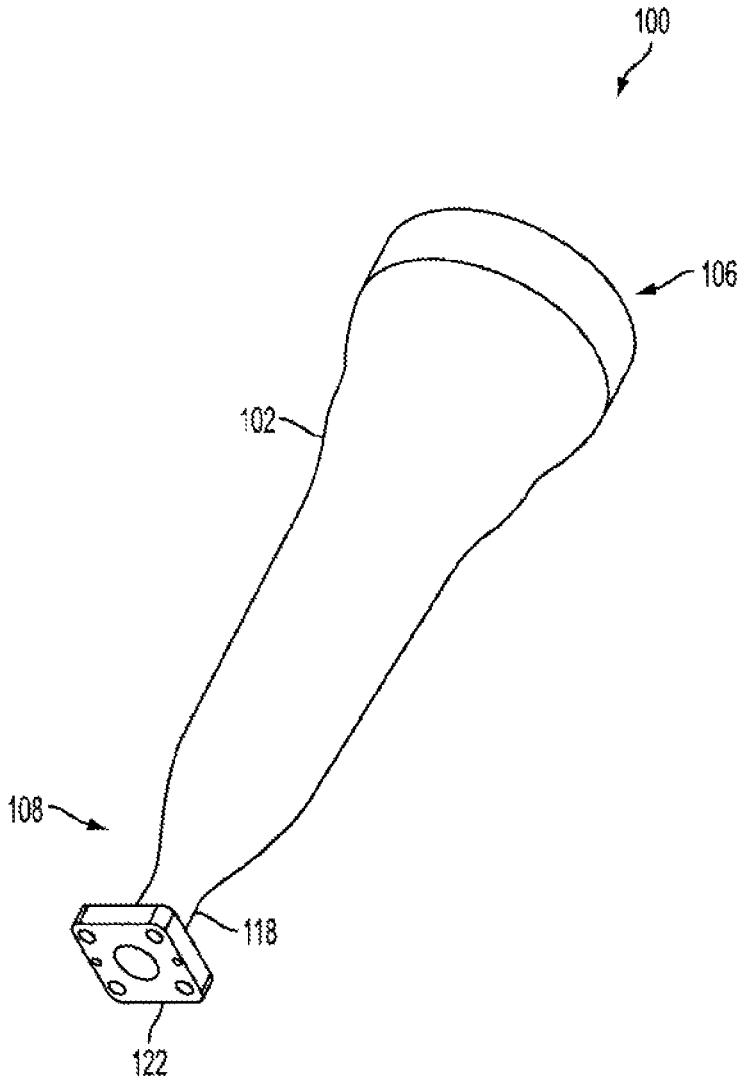
FIG. 1B is a perspective view of the device of FIG. 1A.

The device 100 can also include an input waveguide section 118 attached to the feed end 108 of the feedhorn 102 according to some embodiments of the current invention. There is a discontinuity 120 between the input waveguide section 118 and the feed end 108 of the feedhorn 102. The input waveguide section 118 can include a flange 122 such that the device 100 can be bolted to a waveguide, for example. FIG. 1B is a perspective view of the device 100. The size of the feedhorn aperture (open end) 106 is used to define the angular acceptance or "beamwidth" of the device.

The feedhorn 102 has a mode converter section 124 and a flair section 126. The mode converter section 124 is the section in which the traveling electromagnetic radiation is converted from a single of mode, to a plurality of propagating modes which approximates the $HE_{11}$ mode. In some embodiments, there can be a transition zone between the mode converter section 124 and a flair section 126 rather than a sharp localized change.

An operating bandwidth of the feedhorn 102 can be in a microwave to submillimeter portion of the electromagnetic spectrum. For example, in one particular embodiment the feedhorn 102 was designed to operate in the 33 GHz to 45 GHz band. The term beamwidth is a measure of angular acceptance of the device. The waveguide input of the device can support two polarization modes which would ideally be unmixed. The term cross polarization response as used herein is used to characterize the angular response of when the device is illuminated by a source with is perpendicular to the receiving polarization. In particular we employ Ludwig's third definition (A. Ludwig, "The definition of cross polarization," *IEEE Transactions on Antennas and Propagation*, vol. 21, no. 1, pp. 116-119, 1973).

An embodiment of the current invention provides a method of producing a feedhorn for receiving or transmitting electromagnetic radiation. The method includes determining a profile of an inner surface of the feedhorn based on constraints required to achieve a plurality of operating parameters, providing a pre-machined feedhorn having an initial inner surface, and machining the initial inner surface of the pre-machined feedhorn to substantially match the profile determined to achieve the plurality of operating parameters for the feedhorn. The determining the profile includes a constraint for the profile to be a monotonically increasing profile relative to a rotational symmetry axis of the inner surface of the feedhorn going from a narrow end to a wide end of the feedhorn. According to some embodiments of the current invention, the plurality of operating parameters can include a cross polarization response and a return loss of the feedhorn, for example. However, feedhorns and methods of manufacturing the feedhorns are not limited to only these examples. Furthermore, feedhorns according to the current invention can in some cases be manufactured by this method, but they can also be manufactured by other methods without departing from the general scope of the current invention.

According to some embodiments of this manufacturing method, the feedhorn can have an operating bandwidth with a maximum of −30 dB cross polarization response over at least 15% of said operating bandwidth. According to some embodiments of this manufacturing method, the feedhorn can have an operating bandwidth with a maximum of −30 dB cross polarization response over at least 20% of said operating bandwidth. According to further embodiments of this manufacturing method, the feedhorn can have an operating bandwidth with a maximum of −30 dB cross polarization response over at least 30% of said operating bandwidth. According to some embodiments of this manufacturing method, the feedhorn can have a return loss of less than about −25 dB.

EXAMPLES

Smooth-Walled Feedhorn Optimization

The performance of a feedhorn can be characterized by angle- and frequency-dependent quantities that include beam width, sidelobe response and cross-polarization. Quantities such as reflection coefficient and polarization isolation that only depend on frequency are also important considerations. All of these functions are dependent upon the shape of the feed profile. In the optimization approach according to an embodiment of the current invention, a weighted penalty function is used to explore and optimize the relationship between the feed profile and the electromagnetic response.

Beam Response Calculation

The smooth-walled feedhorn in this example was approximated by a profile that consists of discrete waveguide sections, each of constant radius. With this approach, it is important to verify that each section is thin enough that the model is a valid approximation of the continuous profile. For profiles relevant to our design parameters, section lengths of $\Delta l \leq \lambda_c/20$ were found to be sufficient by trial and error, where $\lambda_c$ is the cutoff wavelength of the input waveguide section. It is possible in principle to dynamically set the length of each section to optimize the approximation to the local curvature of the horn. This would increase the speed of the optimization; however, for simplicity, this detail was not implemented with the current examples.

For each trial feedhorn the angular response was calculated directly from the modal content at the feed aperture. This in turn was calculated as follows. The throat of the feedhorn (also know of the mode converter section) was assumed to be excited by the circular waveguide $TE_{11}$ mode. The modal content of each successive section was then determined by matching the boundary conditions at each interface using the method of James (G. L. James, "Analysis and design of $TE_{11}$ to $HE_{11}$ corrugated cylindrical waveguide mode converters," *IEEE Transactions on Microwave Theory and Techniques*, vol. MTT-29, no. 10, pp. 1059-1066, 1981). The cylindrical symmetry of the feed limits the possible propagating modes to those with the same azimuthal functional form as $TE_{11}$ (A. Olver, P. Clarricoates, A. Kishk, and L. Shafai, Microwave Horns and Feeds., IEEE Press, 1994). This azimuthal-dependence extends to the resulting beam patterns, allowing the full beam pattern to be calculated from the E- and H-plane angular response. Ludwig's third definition (A. Ludwig, "The definition of cross polarization," *IEEE Transactions on Antennas and Propagation*, vol. 21, no. 1, pp. 116-119, 1973) is employed in calculation and measurement of cross-polar response. We note that an additional consequence of the feedhorn symmetry is that to the extent that the E- and H-planes are equal in both phase and amplitude, the cross-polarization is zero (P.-S. Kildal, *Foundations of Antennas: A Unified Approach*. The Netherlands: Studentlitteratur AB, 2000). Changes in curvature in the feed profile can excite higher order modes (e.g., $TE_{12}$ and $TM_{12}$), the presence of which can potentially degrade the cross-polarization response of the horn.

Penalty Function

We constructed a penalty function to optimize the antenna profile according to an embodiment of the current invention. The penalty function with normalized weights, $\alpha_j$, is written as $$\chi^2 = \sum_{i=1}^{N} \sum_{j=1}^{M} (\alpha_j \Delta_j(f_i)^2), \tag{1}$$

where i sums over a discrete set of (N) frequencies in the optimization frequency band, and j sums over the number (M) of discrete parameters one wishes to take into account for the optimization. In the parameter space considered, this function was minimized over the frequency range $1.25f_c<f<1.71f_c$ ($\Delta f/f_0$=0.3) to find the desired solution. Results reported here were obtained by restricting this penalty function to include only the cross-polarization and reflection ($|S_{11}|^2$) with uniform weights (M=2). However, broad concepts of the current invention are not limited to feedhorns that satisfy only these two parameters. Additional parameters have also been explored; however, they were found to be subdominant in producing the target result. These functions were evaluated at 13 equally-spaced frequency points in Equation 1 in one example. The explicit forms used for $\Delta_1(f)$ and $\Delta_2(f)$ are $$\Delta_1(f) = \begin{cases} XP(f) - XP_0 & \text{if } XP(f) > XP_0, \\ 0 & \text{if } XP(f) \le XP_0, \end{cases} \quad (2)$$

$$\Delta_2(f) = \begin{cases} RP(f) - RP_0 & \text{if } RP(f) > RP_0, \\ 0 & \text{if } RP(f) \le RP_0, \end{cases} \quad (3)$$

where XP(f) and RP(f) are the maximum of the cross-polarization XP(f)=Max[XP(f,θ)] and reflected power at frequency f, respectively. $XP_0$ and $RP_0$ are the threshold cross-polarization and reflection. If either the cross-polarization or reflection at a sampling frequency were less than its critical value, it was omitted from the penalty function. Otherwise, its squared difference was included in the sum in Equation 1.

Feedhorn Optimization

The feedhorn was optimized in a two-stage process that employed a variant of Powell's method (W. Press, S. Teukolsky, W. Vetterling, and B. Flannery, *Numerical Recipes* in C, 2nd ed. Cambridge University Press, 1992). Generically, this algorithm can produce an arbitrary profile. To produce a feed that is easily machinable, we restricted the optimization to the subset of profiles for which the radius increases monotonically along the length of the horn. Without this constraint, this method was observed to explore solutions with corrugated features and the serpentine profiles explored in (H. Deguchi, M. Tsuji, and H. Shigesawa, "Compact low-cross-polarization horn antennas with serpentine-shaped taper," *IEEE Transactions on Antennas and Propagation*, vol. 52, no. 10, pp. 2510-2516, 2004).

The aperture diameter of the feedhorn was initially set to $\approx 4\lambda_c$, but was allowed to vary slightly to achieve the desired beam size. A single discontinuity exists between the circular waveguide and the feed throat. The remainder of the horn profile adiabatically transitions to the feed aperture. The total length of the feedhorn from the aperture to the single mode waveguide was fixed at $12.3\lambda_c$ during optimization. This length is somewhat arbitrary, but chosen to produce a stationary phase center and a diffraction-limited beam in a practical volume.

The approach of (Granet et al., supra) was followed as an initial input to the Powell method. Specifically, the feed radius, r, is written analytically as a function of the distance along the length of the horn, z, as:

$$r(z) = \begin{cases} 0.293 + 0.703\sin^{0.75}(0.255z) & 0 \le z \le 6.15, \\ 0.293 + 0.703\{1 + [0.282(z - 6.15)]^2\}^{\frac{1}{2}} & 6.15 < z \le 12.30, \end{cases} \quad (4)$$

where parameters are given in units of $\lambda_c$. This profile was then approximated by natural spline of a set of 20 points equally-spaced along the feed length. Throughout the optimization, we explicitly imposed the condition that the radius of each section be greater than or equal to that of the previous section such. This sampling choice effectively limits the allowed change in curvature along the feed profile. In the first stage of optimization, both $XP_0$ and $RP_0$ were set to −30 dB. The minimum of the penalty function was found by the modified Powell method in this 20-dimension space.

In the second stage of the optimization, the number of points explicitly varied along the profile was increased to 560. The modified Powell method was used to optimize the profile in this 560-dimensional space. In this stage, both of $XP_0$ and $RP_0$ were decreased to −34 dB.

In principle, it is possible to use either of these techniques alone to find our solution. There are enough degrees of freedom in the 20-point spline to do so and the 560-point technique should be able to recover the solution regardless of the starting point. We found, however, that the 20-point spline did not converge readily to the final profile given the initial conditions above, but rather converged to a broad local minimum. In addition to finding the general features of the desired performance, this first stage of optimization provided a significant reduction in the use of computing resources compared to the slower 560-point parameter search.

Figure 1C:
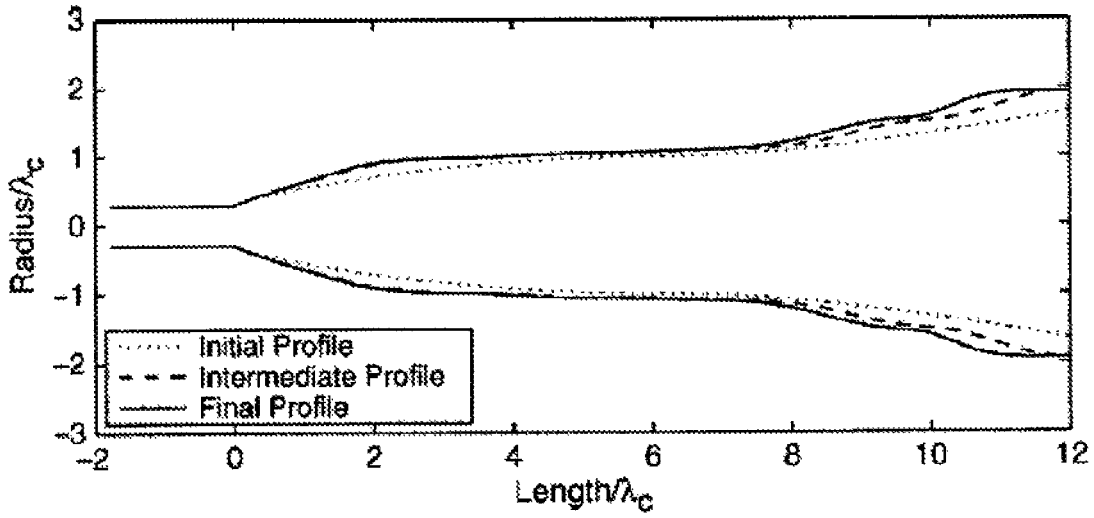
FIG. 1C shows the initial, intermediate and final profiles of a feedhorn according to an embodiment of the current invention. All dimensions are given in units of the cutoff wavelength of the input circular waveguide.

FIG. 1C shows the initial, intermediate, and final feedhorn profiles. It is possible to approximate the final profile with a 20-point spline. The final profile of the feed is reproduced with a low-spatial frequency error of $\approx 0.015\lambda_c$. This effect has a negligible influence on the modeled performance. This suggests that the optimization procedure could be done completely using a spline with fewer than 20 points if the location of the spline points were dynamically varied. Future optimization algorithms could be made more efficient by implementing this approach.

Feedhorn Fabrication and Measurement

Figure 3:
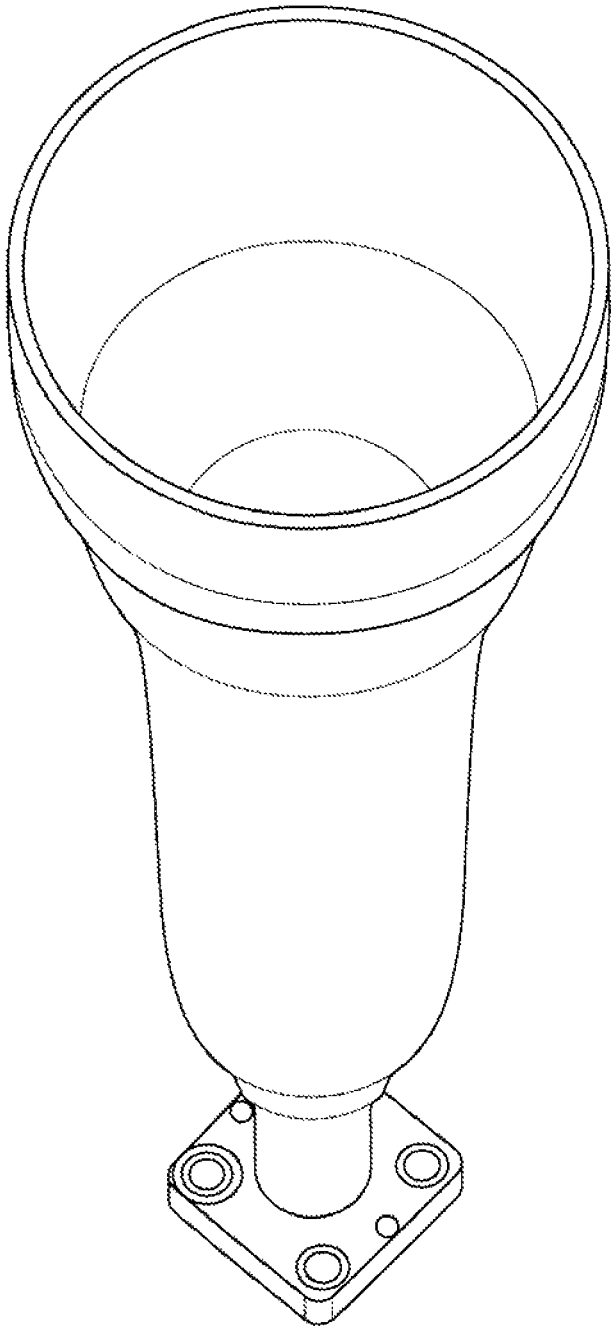
FIG. 3 shows a smooth-walled feedhorn designed to operate between 33 and 45 GHz according to an embodiment of the current invention. The feedhorn is 140 mm long with an aperture radius of 22 mm. The input circular waveguide radius is 3.334 mm.

A feed (FIG. 3) that operates in circular waveguide with a $TE_{11}$ cutoff frequency of $f_c$=26.36 GHz was fabricated to test a design according to an embodiment of the current invention. The structure was optimized between 33 and 45 GHz. The prototype feed was manufactured via electroforming in order to validate the design using a process that allows the feed structure to be measured and compared to the design profile. However, other manufacturing techniques could be used, such as, but not limited to, machining techniques. The final design profile is well-approximated by splining the radius (r) as a function of length (z) provided in Table 1.

The feedhorn was measured in the Goddard Electromagnetic Anechoic Chamber (GEMAC). The receivers and microwave sources used in the measurement provide a >50 dB dynamic range from the peak response over $\approx 2\pi$ steradians with an absolute accuracy of <0.5 dB. A five section constant cutoff transition from rectangular waveguide (WR 22.4, $f_c$=26.36 GHz) to circular waveguide (E. Wollack, "TCHEB_x: Homogeneous stepped waveguide transformers," *NRAO, EDTN Memo Series* #176, 1996) was used to mate the feedhorn to the rectangular waveguide of the antenna range infrastructure. The constant cutoff condition was maintained in the transition by ensuring $a_{circle}=a_{broadwall}s_{11}/\pi$ where $a_{circle}$ is the radius of the circular guide, $a_{broadwall}$ is the width of the broadwall of the rectangular guide, and $s_{11}\approx 1.841$ is the eigenvalue for the $TE_{11}$ mode (J. Pyle and R. Angley, "Cutoff wavelengths of waveguides with unusual cross sections (correspondence)," *IEEE Transactions on Microwave Theory and Techniques*, vol. 12, no. 5, pp. 556-557, 1964). The alignment of the circular waveguide feed interface was maintained to avoid degradation of the cross-polar antenna response. Pinning of this interface as specified in (J. Hesler, A. Kerr, W. Grammer, and E. Wollack, "Recommendations for waveguide interfaces and frequency bands to 1 THz," 18*th International Symposium on Space Terahertz Technology*, pp. 100-103, 2007) or similar is recommended.

Figure 4:
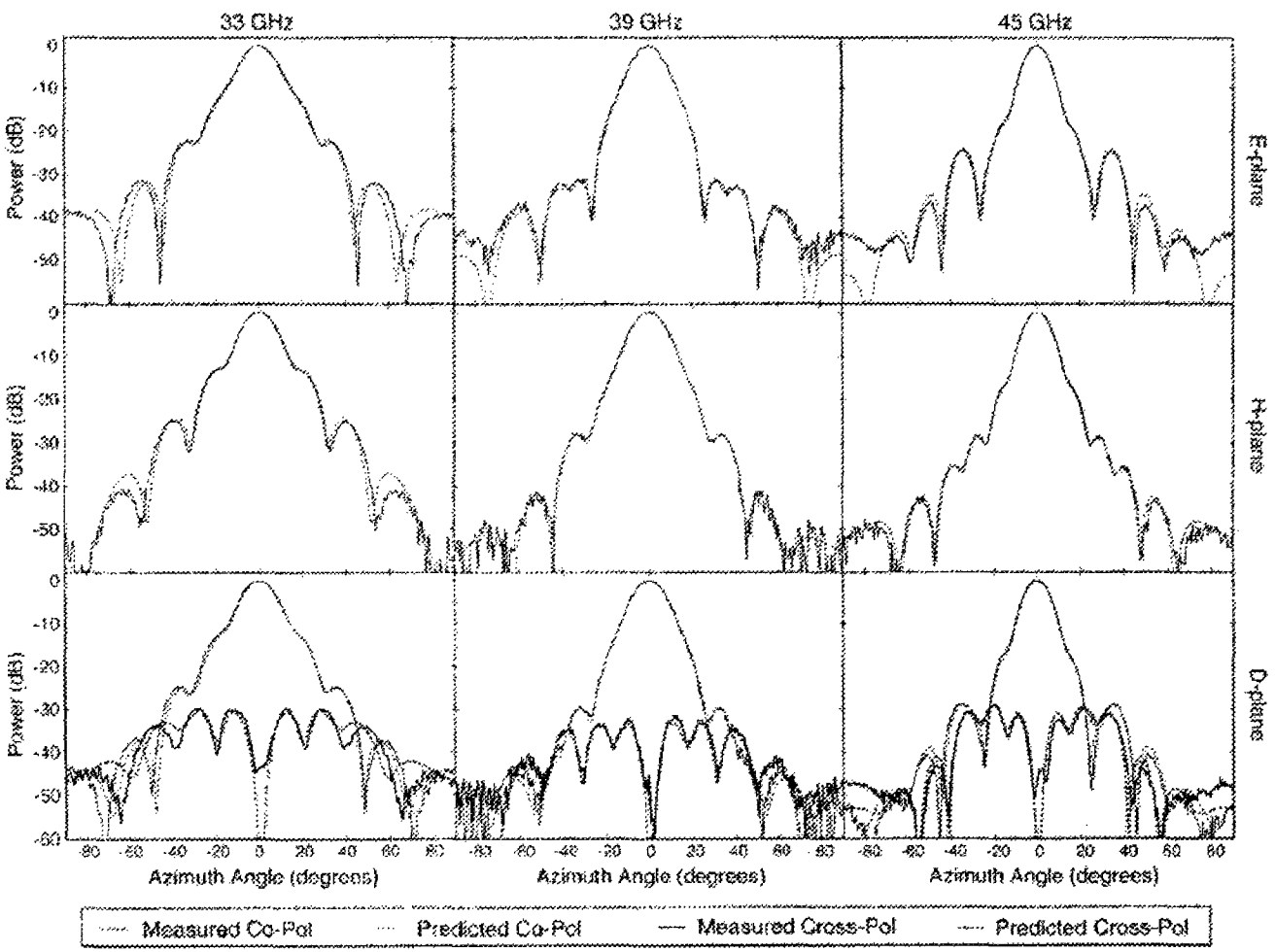
FIG. 4 shows the measured E-, H-, and diagonal-plane angular responses for the lower edge (33 GHz), center (39 GHz), and upper edge (45 GHz) of the optimization band according to an embodiment of the current invention. The cross-polar patterns in the diagonal plane are shown in the bottom three panels for each of the three frequencies.
Figure 5:
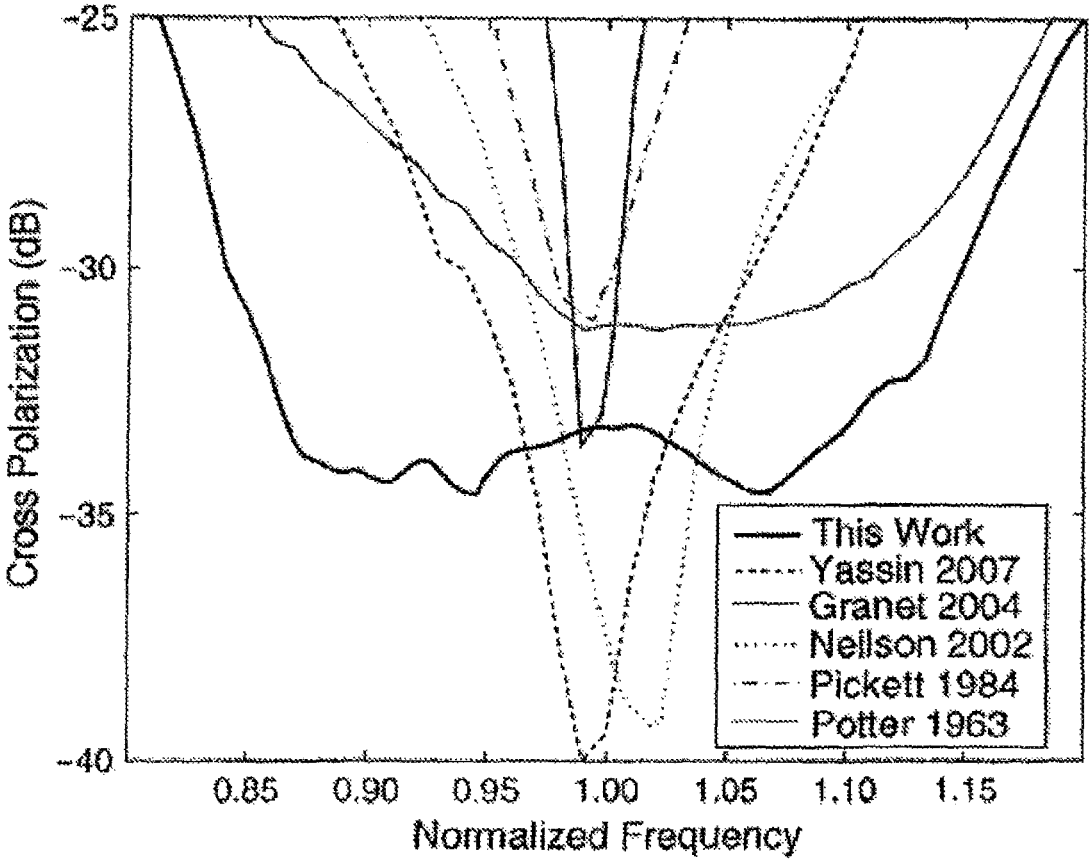
FIG. 5 shows the maximum cross-polar response of the feedhorn of FIG. 1C according to an embodiment of the current invention as compared to conventional smooth-walled feedhorns. The data presented have been normalized to the design center frequencies as specified by the respective authors.

Beam plots and parameters at the extrema and the middle of the optimization frequency range are shown in FIG. 4 and Table 2. The cross-polarization response as a function of frequency of this device is compared to other published implementations of multi-mode scalar feeds (FIG. 5). As is common for applications requiring the beam symmetry provided by a scalar horn, the aperture efficiency is low. In addition, we note that the phase center for this horn is near the aperture and is stable in frequency.

Figure 2:
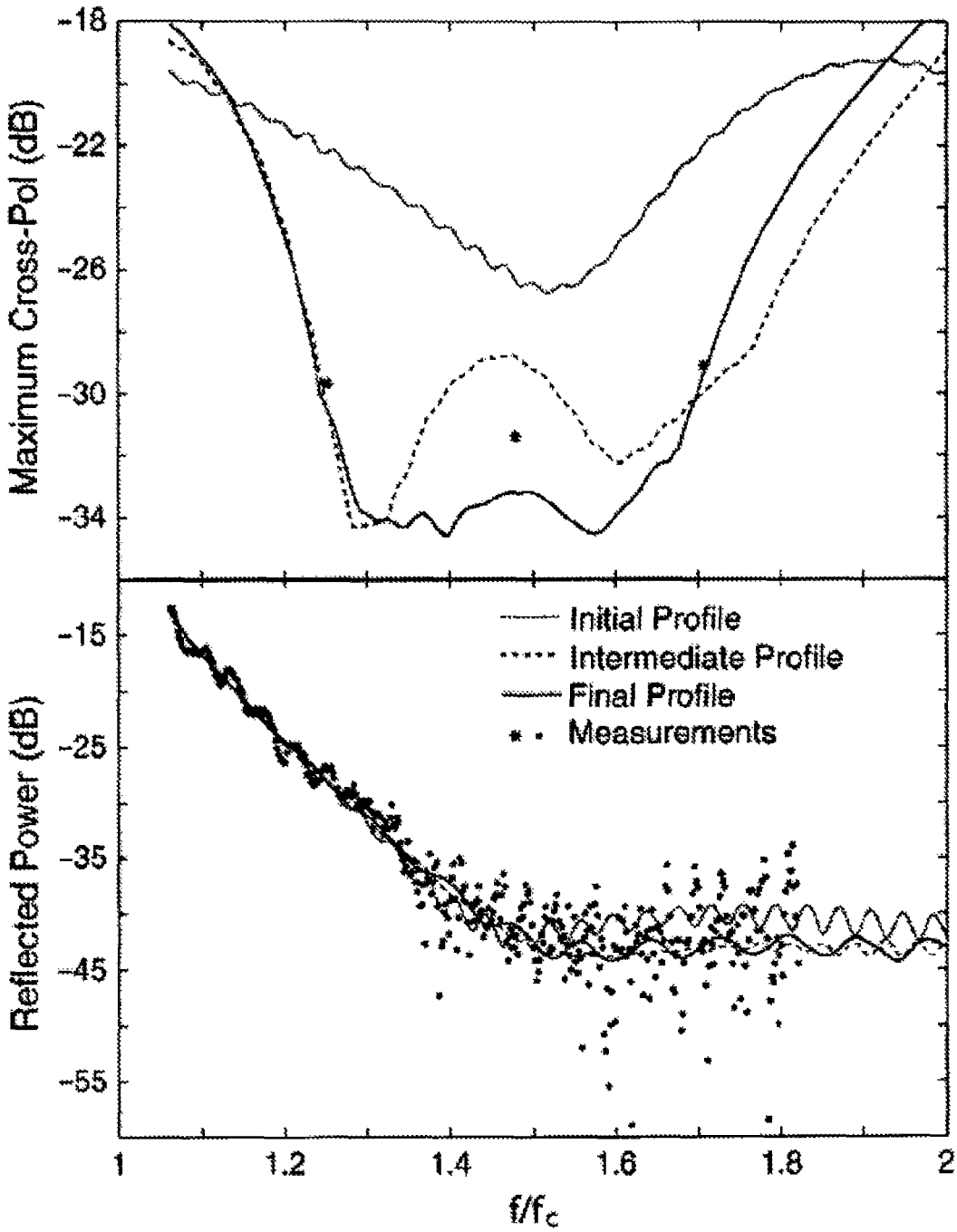
FIG. 2 shows the improvement in cross-polarization for the two stages of optimization of feedhorns according to an embodiment of the current invention. The reflection is also shown for the initial profile, the intermediate optimization, and the final feedhorn profile.

An HP8510C network analyzer was used to measure the reflected power (see FIG. 2) with a through-reflect-line calibration in circular waveguide. If desired, the match at the lower band edge can be improved by using a transition to a larger diameter guide. The measured observations are in agreement with theory.

TABLE 1

Spline approximation to optimized profile (in millimeters)

| Section | Length (z) | Radius (r) |
|---|---|---|
| 0 | 0.0 | 3.33 |
| 1 | 7.0 | 5.77 |
| 2 | 14.0 | 7.91 |
| 3 | 21.0 | 9.90 |
| 4 | 28.0 | 10.86 |
| 5 | 35.0 | 11.13 |
| 6 | 42.0 | 11.27 |
| 7 | 49.0 | 11.66 |
| 8 | 56.0 | 11.90 |
| 9 | 63.0 | 11.96 |
| 10 | 70.0 | 12.24 |
| 11 | 77.0 | 12.44 |
| 12 | 84.0 | 12.76 |
| 13 | 91.0 | 13.70 |
| 14 | 98.0 | 15.40 |
| 15 | 105.0 | 17.01 |
| 16 | 112.0 | 17.71 |
| 17 | 119.0 | 20.05 |
| 18 | 126.0 | 21.75 |
| 19 | 133.0 | 21.91 |
| 20 | 140.0 | 21.92 |

Imperfections in the profile may occur during manufacturing due to chattering of the tooling or similar physical processes. We performed a tolerance study to determine the effect of such high-spatial frequency errors in the feed radius. Negligible degradation in performance was observed for Gaussian errors in the radius up to $0.002\lambda_c$. The feed's monotonic profile is compatible with machining by progressive plunge milling in which successively more accurate tools are used to realize the feed profile. This technique has been used for individual feeds and is potentially useful for fabricating large arrays of feedhorns. Examples include fabrication of multimode Winston concentrators (D. J. Fixsen, "Multimode antenna optimization," R. Winston, Ed., vol. 4446, no. 1, SPIE, 2001, pp. 161-170; D. J. Fixsen, E. S. Cheng, T. M. Crawford, S. S. Meyer, G. W. Wilson, E. S. Oh, and E. H. S. III, "Lightweight long-hold-time dewar," *Review of Scientific Instruments*, vol. 72, no. 7, pp. 3112-3120, 2001), direct-machined smooth-walled conical feed horns for the South Pole Telescope (W. Holzapfel and J. Ruhl, *Private Communication,* 2009), and the exploration of this technique for dual-mode feedhorns (Yassin et al, supra).

TABLE 2

Beam Parameters

| Frequency [GHz] | Wavelength [mm] | Antenna Gain [dBi] | Beam Solid Angle [Sr] |
|---|---|---|---|
| 33 | 9.09 | 21.3 | 0.0925 |
| 39 | 7.69 | 22.0 | 0.0788 |
| 45 | 6.67 | 24.2 | 0.0473 |

An optimization technique for a smooth-walled scalar feedhorn has been presented as an example according to an embodiment of the current invention. Using this flexible approach, we have demonstrated a design having a 30% bandwidth with cross-polar response below −30 dB. The design was tested in the range 33-45 GHz and found to be in agreement with theory. The design's monotonic profile and tolerance insensitivity can enable the manufacturing of such feeds by direct machining. This approach can also be useful in applications where a large number of feeds are desired in a planar array format.

The embodiments illustrated and discussed in this specification are intended only to teach those skilled in the art the best way known to the inventors to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A method of producing a feedhorn for receiving or transmitting electromagnetic radiation, comprising:

determining a profile of an inner surface of said feedhorn based on constraints required to achieve a plurality of operating parameters;

providing a pre-machined feedhorn having an initial inner surface; and machining said initial inner surface of said pre-machined feedhorn to substantially match said profile determined to achieve said plurality of operating parameters for said feedhorn, wherein said determining said profile includes a first constraint for said profile to be a monotonically increasing profile relative to a rotational symmetry axis of said inner surface of said feedhorn going from a narrow end to a wide end of said feedhorn, and wherein said determining said profile includes a second constraint for an E-plane and an H-plane co-polar response of said feedhorn to be sufficiently equal such that the cross polarization response over all angles is less than a pre-determined value.

2. A method of producing a feedhorn according to claim 1, wherein said plurality of operating parameters include a cross polarization response and a return loss of said feedhorn.

3. A method of producing a feedhorn according to claim 1, wherein said feedhorn has an operating bandwidth and provides a maximum of −30 dB cross polarization response over at least 15% of said operating bandwidth.

4. A method of producing a feedhorn according to claim 3, wherein said maximum of −30 dB cross polarization response is provided over at least 20% of said operating bandwidth.

5. A method of producing a feedhorn according to claim 3, wherein said maximum of −30 dB cross polarization response is provided over at least 30% of said operating bandwidth.

6. A method of producing a feedhorn according to claim 3, wherein said operating bandwidth of said feedhorn is in a microwave region of the electromagnetic spectrum.

7. A method of producing a feedhorn according to claim 3, wherein said operating bandwidth of said feedhorn is from 33 GHz to 45 GHz.

8. A method of producing a feedhorn according to claim 3, wherein side lobes of response of said feedhorn are less than at least −20 dB below a peak response of said feedhorn.

9. A method of producing a feedhorn according to claim 1, wherein said feedhorn has a return loss of less than about −25 dB.

10. A feedhorn produced according to the method of claim 1.

11. A method of producing a feedhorn according to claim 1, wherein determining a profile of an inner surface of said feedhorn based on constraints further comprises applying said constraints at a plurality of points on said inner surface of said feedhorn, wherein a distance between each one of said plurality of points and an adjacent one of said plurality of points is less than or equal to $\lambda_c/2$, where $\lambda_c$ is a cutoff wavelength of an input waveguide section of the feedhorn.

* * * * *